US005858023A

United States Patent [19]

Bamford et al.

[11] Patent Number: 5,858,023

[45] Date of Patent: Jan. 12, 1999

[54] SOFTENING AGENTS

[75] Inventors: Susan Bamford, Ripley; David Longley Connell, Western Underwood; Kenneth Michael Huddlestone, Allestree, all of England

[73] Assignee: Precision Processes Textiles, United Kingdom

[21] Appl. No.: 435,619

[22] Filed: May 5, 1995

Related U.S. Application Data

[63] Continuation of Ser. No. 975,946, filed as PCT/GB91/01793, Oct. 15, 1991, abandoned.

[30] Foreign Application Priority Data

Oct. 15, 1990 [GB] United Kingdom ..... 9022305

[51] Int. Cl.[6] ..... D06M 15/53; D06M 15/61

[52] U.S. Cl. ..... 8/196; 8/198; 8/127.6; 8/115.51; 8/115.65; 8/115.6; 8/115.61; 8/127.5; 252/8.61; 252/8.84; 252/8.85; 252/8.96; 252/8.91; 427/389.9; 427/392

[58] Field of Search ..... 8/196, 188, 181, 8/127.6, 115.65, 115.61, 127.5, 194, 115.51, 115.6; 252/8.8, 8.61, 8.87, 8.85, 8.86, 8.91, 8.84; 427/389.9, 392

[56] References Cited

U.S. PATENT DOCUMENTS

| | | | |
|---|---|---|---|
| 2,961,347 | 11/1960 | Floyd | 428/254 |
| 3,038,820 | 6/1962 | Albrecht . | |
| 3,243,253 | 3/1966 | Miller et al. | 8/196 |
| 3,347,803 | 10/1967 | Frotscher | 427/386 |
| 3,933,421 | 1/1976 | Lewis | 8/428 |
| 3,966,659 | 6/1976 | Oxe et al. | 252/8.62 |
| 4,255,311 | 3/1981 | Eldin et al. | 252/8.61 |
| 4,277,243 | 7/1981 | Rowland | 8/183 |
| 5,438,116 | 8/1995 | Connell | 528/407 |

FOREIGN PATENT DOCUMENTS

| | | |
|---|---|---|
| 0414377A2 | 2/1991 | European Pat. Off. . |
| 1165287 | 10/1958 | France . |
| 1419042 | 3/1969 | Germany . |
| 797175 | 6/1958 | United Kingdom . |
| 880897 | 10/1961 | United Kingdom . |
| 913911 | 12/1962 | United Kingdom . |
| 1171304 | 11/1969 | United Kingdom . |

*Primary Examiner*—Alan Diamond

*Attorney, Agent, or Firm*—Wenderoth, Lind & Ponack, L.L.P.

[57] ABSTRACT

A method for the treatment of natural or synthetic fibers, such as wool, cotton, nylon or acrylic, so as to impart a softer handle, comprising treating the fibers with a polymer or prepolymer as defined. The method may be performed as either a continuous process or as a batch process.

12 Claims, No Drawings

SOFTENING AGENTS

This application is a continuation of application, Ser. No. 07/975,946, filed Feb. 24, 1993, now abandoned which is the U.S. national stage application of PCT/GB91/01792, filed Oct. 15, 1991.

This invention relates to the novel use of known polymers and prepolymers as softening agents to improve the handle of both natural and synthetic fibres.

Traditionally employed softening agents have as their basis either fatty acid or reactive siloxane chemistry. In both cases, the use of such agents imparts a degree of hydrophobicity to the treated fibres. While attempts have been made to overcome this effect by the incorporation of hydrophilic groups, such as amino, quaternary ammonium and polyethylene oxide groups, these generally have the effect of reducing the softness of handle that can be achieved and some hydrophobicity nevertheless remains. In addition, particularly in the case of fatty amide based softening agents, the effects are transitory and tend to be readily removed upon subsequent wet processing of the treated fibres or during domestic washing of the finished product. Consequently, it has been necessary either to re-soften the material by re-applying a softening agent (which is inefficient and uneconomic) or to tolerate a reduction in the level of softness following washing of the product.

British Patent Nos. 1470243 and 1533343 describe compounds containing aziridine radicals and their use for reducing the shrinkage and felting of protein fibres. One of the compounds disclosed is that sold under the trade name Basolan SW, and which is marketed as a hydrophilic polymer that is said to achieve a soft hydrophilic finish when applied to synthetic fibres.

The present invention seeks to provide improved softening agents suitable for use with both natural and synthetic fibres. The polymers and prepolymers employed for this purpose are the subject of our co-pending European Patent Application No. 90307951.5.

The polymers and prepolymers of this invention essentially result from the reaction of one or more polyoxyalkyleneamines, either as a simple mixture or joined by a polyfunctional bridging group in a prior reaction, with an epihalohydrin or other reactive species, such as formaldehyde, so as to generate a grouping on the molecule capable of reacting with protein fiber surfaces. The reactants are used in such proportions that preferably, though not necessarily, all of the amino groups are reacted.

The chemistry and reactions of the epihalohydrins, the alkyl polyhalides and formaldehyde, etc., are well known and it is not necessary to describe in detail the conditions required for their reaction with the polyoxyalkyleneamines according to this invention. The proportions used, however, are preferably such as to ensure that substantially all of the amino groups in the polyoxyalkyleneamine residues are reacted. The reaction is best performed at elevated temperature, typically within the range of from 40 to 150° C.

The present invention relates to polymers and prepolymers which may be represented by any one of the following formulae:

(i)

$$Z—\{[A]_m—N(R_1)_n\}_r \quad (I)$$

which may be expressed more simply as:

$$J[N(R_1)_n]_r \quad (II)$$

or ii) structure involving crosslinking or bridging of the above groups (I) or (II):

$$[[(R_1)_nN+A\underset{m}{]}\underset{s}{]}Z[[A\underset{m}{]}N(R_1)\underset{n-1}{]}\underset{r-s}{]}\underset{t}{]}B \quad (III)$$

which may be expressed more simply as:

$$[[(R_1)_nN\underset{s}{]}J+N(R_{n-1})\underset{r-s}{]}\underset{t}{]}B \quad (IV)$$

or iii) a low molecular weight polymeric structure formed from the above groups (I) or (II):

$$\{K\}_x—\{B\}_y—K \quad (V)$$

wherein

Z represents a residue of a polyol, preferably a di- or trivalent polyol;

A represents a polyalkylene oxide residue, that is a polyether chain produced by polymerisation of, for example, ethylene, propylene or butylene oxides or tetrahydrofuran;

B is the residue created by bi- or polyfunctional reaction between any polyfunctional reactive group and the parent amine of the title compounds (formula (I) where $R_1$ is hydrogen in all cases), or is the residue of a reactive amino-acrylic polymer (e.g. of the type described in EP-A-0129322) or a reactive polyamide polymer (e.g. of the type described in EP-A-0260017A or a Hercosett polymer), and may be taken, for example, to represent a group $$—E—(R_3)_pN—[D]—N(R_3)_p—E— \quad (VI)$$

a group

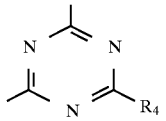

(VII)

a group resulting from the reaction of a bi-or polyfunctional species capable of reacting with amino groups, for example: epihalohydrins, alkyl di-and polyhalides, di- or polycarboxylic acids or their acyl halides and anhydrides, dicyandiamide, urea and formaldehyde, a group derived from low molecular weight reactive resins such as the Bisphenol A type, or a group derived from reaction of a cationic polymeric reactive species such as

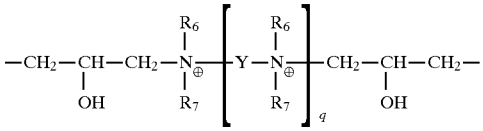

where $R_6$ and $R_7$ are selected from $C_1$–$C_5$ alkyl and $C_2$–$C_5$ hydroxyalkyl radicals.

Y is selected from $C_2$–$C_6$alkylene radicals, 2-hydroxy-1, 3-propylene radicals, and the radicals:

—$CH_2CH_2NHCONHCH_2CH_2$— and

—$CH_2CH_2CH_2NHCONHCH_2CH_2CH_2$— and q is an integer of from 0 to 20, provided that when q is greater than 2, each of the symbols Y need not necessarily have the same significance;

D represents a straight or branched chain hydrocarbon, polysiloxane or polyalkylene oxide residue, and which may also either bear functional groups or may contain functional groups, such as amino groups, which may in turn either bear one or more groups $R_1$ or, where B is polyfunctional rather than bifunctional, may represent a further functional reaction point of the group B with the rest of the molecular structure;

E represents a group resulting from the reaction of a bi- or polyfunctional species capable of reacting with amino groups, for example: epihalohydrins, alkyl di- and polyhalides, dicarboxylic acids or their acyl halides and anhydrides, dicyandiamide, urea and formaldehyde:

J represents a residue derived from a polyfunctional polyether;

K represents the monofunctional or polyfunctional residue derived from partial reaction of the basic prepolymers in formulae (I) or (II), i.e. it represents the shaded area in formula (III) as follows:

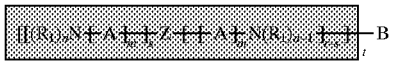

$R_1$ represents a fibre reactive grouping such as the residue derived from monofunctional reaction of an epihalohydrin, an alkyl or alkyl aryl polyhalide or a methylol grouping derived from monofunctional reaction of formaldehyde, or is alkyl, hydroxyalkyl or hydrogen, with the proviso that at least one group $R_1$ per polyoxyalkyleneamine residue, and preferably at least one for each nitrogen, retains residual fibre reactivity;

$R_2$ represents a fibre reactive grouping such as the residue derived from monofunctional reaction of an epihalohydrin, an alkyl or alkyl aryl polyhalide or is a methylol grouping derived from monofunctional reaction of formaldehyde, or alkyl, hydroxyalkyl or hydrogen;

$R_3$ represents hydrogen or $C_1$–$C_4$ alkyl or hydroxyalkyl;

$R_4$ represents halogen or a group $$[[(R_2)_nN]_s J[N(R_2)_{n-1}]_{r-s}] \quad \text{(VIII)}$$

or one of alkylamino, hydroxyalkylamino, alkoxy, alkylarylamino or a group $—(R_3)_pN[D]—R_5$ or a functional reaction point of the group B with the rest of the molecular structure, where B is polyfunctional rather than bifunctional;

$R_5$ represents hydrogen or a group $—N(R_2)_n$ or $—N(R_3)_n$;

m is between 4 and 50:

n is 2 or 3, with the proviso that, where n is 3, the nitrogen atom involved also bears a formal positive charge;

p is 1 or 2, with the proviso that, where p is 2, the nitrogen atom involved also bears a formal positive charge;

r equals the functionality of group Z;

t is a number representing the functionality of reaction of the residue B;

s is a number between 1 and r−1;

x is between 2 and 30; and y is from $$\frac{x}{t-1}$$

to x, with the general proviso that, in any given instance, the significance of a particular group Z, A, B, R, J or K in any given structure shall not be dictated by the significance of any other such group in the same formula, and further, wherever a formal positive charge is present in the structure, then an appropriate counter anion is taken to be present, for example chloride ion.

The term "fibre reactive grouping" as used herein is to be understood as meaning a group having residual chemical reactivity such that it will be capable of causing a molecule to be bound to the surface of a fibre in such a way as not to be readily removable therefrom. Examples include the fibre reactive dyes in which a variety of reactive halogen groupings are sited on the molecule and which, during dyeing, react with hydroxy or amino functionalities on the fibre surface to produce a chemical bond. It will be understood that electrical bonding forces, rather than chemical forces, could be involved and that a "reaction" as such need not occur. The terminology further includes species which will be attracted to a fibre surface and bind themselves thereto by means of cross-linking mechanisms.

The term "polyfunctional reactive group" as used herein is to be understood as meaning a group which is capable of reacting with the amino functionality of compounds of formula I or II. The reactivity of group B needs to be complimentary to that of group $R_1$ in those compounds.

It will be understood that the polymers and prepolymers may be derived from mixtures of one or more polyoxyalkyleneamines and that these may be joined by bridging groups. The bridging groups serve to link the polyoxyalkyleneamines and some examples of suitable groups were mentioned above. The bridging groups themselves could, of course, bear reactive species capable of reacting with protein fibres. It will also be appreciated that the bridging group B could be incorporated into the molecular structure, whilst the prepolymer is being applied to the fibre, as a separate reactive crosslinking agent.

Included in this patent application in this regard are various amino prepolymers whose structures may be defined as follows:

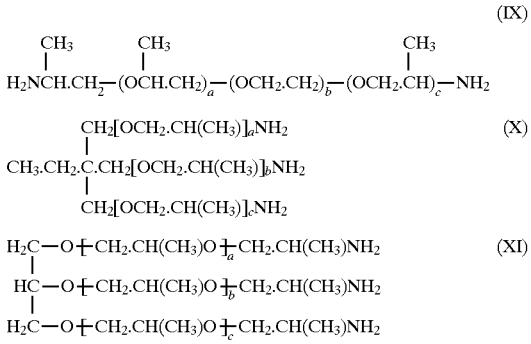

(IX)

(X)

(XI)

In the following examples, a distinction is made between the preparations based on the ratio of epichlorohydrin to amino nitrogen. For example, a 1:1 molar ratio uses 1 mole of epichlorohydrin for each nitrogen atom in 1 mole of the amino containing prepolymer.

EXAMPLE 1

(1.1) Preparation of prepolymer (1:1) adduct

A solution was prepared containing 3000 g (approx. 1 mole) of a compound of formula XI (where a+b+c=50, molecular weight approximately 3000, total amine 6.45 M equivalents/g) in 6726.4 g of a mixture of 70 parts by weight isopropyl alcohol and 30 parts by weight water. To this solution was added 273.6 g (2.96 mole) epichlorohydrin with efficient stirring at room temperature in a reaction flask fitted with a water cooled reflux condenser. The mixture was then heated until the isopropanol began to boil, and then maintained at reflux for approximately 4 hours or until when 5 ml of the reaction mixture was diluted with 30 ml water a clear solution resulted. The flask was then allowed to cool and the reaction mixture tested as in 1.4 below.

(1.2) Preparation of prepolymer (2:1) adduct

The procedure described in 1.1 above was followed with the following changes: 6452.5 g of 70% weight/weight isopropyl alcohol in water were used for the solution and 547.5 g (5.92 mole) of epichlorohydrin added.

(1.3) Preparation of prepolymer (3:1) adduct

The procedure described in 1.1 above was followed except that 6178.9 g of 70% weight/weight isopropyl alcohol in water were used for the solution and 821.1 g (8.88 mole) epichlorohydrin added.

The general procedure of example 1, using in all cases a 70% isopropanol in water solvent, was followed to prepare a number of further adducts of polyether amines either having the general structures:

$$\begin{array}{l} H_2NCH_2.CH_2.CH_2\left[O(CH_2)_4\right]_a O-CH_2 \\ \qquad\qquad\qquad\qquad\qquad\qquad | \\ H_2NCH_2.CH_2.CH_2\left[O(CH_2)_4\right]_b O-CH \\ \qquad\qquad\qquad\qquad\qquad\qquad | \\ H_2NCH_2.CH_2.CH_2\left[O(CH_2)_4\right]_c O-CH_2 \end{array} \quad \text{(XIII)}$$

$$H_2NCH_2.CH_2.CH_2\left[OCH_2CH(C_2H_5)\right]_a OCH_2.CH_2.CH_2NH_2 \quad \text{(XIV)}$$

The following general preparative techniques were used:

A: Condensation reactions with acids:

A known quantity of the amino polyether was placed in a flask equipped with stirrer, distillation condenser, nitrogen bleed and dropping funnel. A known quantity of the bridging compound was added, and the mixture heated to 180°–190° C. with stirring until water was evolved. This was allowed to distill off until the theoretical quantity of water was evolved, or no further water could be removed. The flask was allowed to cool, and a suitable quantity of a specified isopropanol (IPA):water mixture was added to dissolve the product. A specified amount of epichlorohydrin was added and allowed to react at reflux temperature until amine titration indicated the reaction to be complete.

B: Reaction with other bifunctional compounds:

A known quantity of aminopolyether was placed in a flask with a specified quantity of isopropanol (IPA):water mixture. A specified quantity of bridging compound was added and the mixture heated at reflux with stirring for 3 hours. When amine titration indicated the reaction to be complete, a specified quantity of epichlorohydrin was added to the mixture and this was further heated for 4 hours or until an amine titration indicated the reaction to be complete.

Details of the various preparations are given in below. The products were found to be useful as shrink resist agents.

| Example | Bridging Compound | Preparation Procedure | Structure formula of amine | Value of a,b,c | Solvent Mixture | Weight of solvent (g) | Weight of amine (g) | Weight of bridging compound (g) | Weight of epichloro-hydrin (g) |
|---|---|---|---|---|---|---|---|---|---|
| 6.1 | 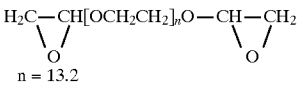 n = 13.2 | B | XI | a + b + c ~ 5.3 | 70 IPA 30 water | 200 | 40 | 14.4 | 16.6 |
| 6.2 | as 6.1 n = 13.2 | B | XI | a + b + c ~ 5.3 | 70 IPA 30 water | 200 | 40 | 21.6 | 12.5 |
| 6.3 | as 6.1 n = 13.2 | B | XII | a = ~27 | 70 IPA 30 water | 200 | 40 | 2.11 | 2.41 |
| 6.4 | as 6.1 n = 13.2 | B | XII | a = ~27 | 70 IPA 30 water | 200 | 40 | 1.60 | 2.77 |
| 6.5 | 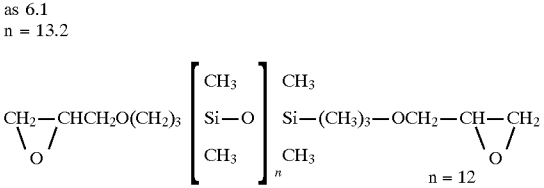 n = 12 | n | XII | a = ~7 | 50 IPA 50 water | 200 | 80 | 63.13 | 9.9 |
| 6.14 | 1,3-dibromopropane | n | XII | a = ~7 | 50 IPA 50 water | 200 | 40 | 5.05 | 4.9 |
| 6.15 | 1,6-dichlorohexane | n | XII | a = ~7 | 50 IPA 50 water | 200 | 40 | 3.88 | 4.9 |
| 6.16 | 1,10-dibromodecane | n | XII | a = ~7 | 50 IPA 50 water | 200 | 40 | 7.5 | 4.9 |

The present invention relates to the use as a softening agent for natural or synthetic fibres of a compound of any one of the following formulae:

i)

$$Z—\{[A]_m—N(R_1)_n\}_r \quad (I)$$

which may be expressed more simply as:

$$J[N(R_1)_n]_r \quad (II)$$

or ii) structure involving crosslinking or bridging of the above groups (I) or (II):

$$[[(R_1)_nN]_s[A]_m]_t Z[[A]_m[N(R_1)_{n-1}]_{r-s}]_t B \quad (III)$$

which may be expressed more simply as:

$$[[(R_1)_nN]_s J[N(R_1)_{n-1}]_{r-s}]_t B \quad (IV)$$

or iii) a low molecular weight polymeric structure formed from the above groups (I) or (II):

$$(K)_x—(B)_y—K \quad (V)$$

wherein

Z represents a residue of a polyol, preferably a di- or trivalent polyol;

A represents a polyalkylene oxide residue, that is a polyether chain produced by polymerisation of, for example, ethylene, propylene or butylene oxides or tetrahydrofuran;

B is the residue created by bi- or polyfunctional reaction between any polyfunctional reactive group and the parent amine of the title compounds (formula (I) where $R_1$ is hydrogen in all cases), or is the residue of a reactive amino-acrylic polymer (e.g. of the type described in EP-A-0129322) or a reactive polyamide polymer (e.g. of the type described in EP-A-0260017A or a Hercosett polymer), and may be taken, for example, to represent a group $$—E—(R_3)_pN—[D]—N(R_3)_p—E— \quad (VI)$$

a group

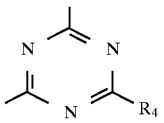

(VII)

a group resulting from the reaction of a bi- or polyfunctional species capable of reacting with amino groups, for example: epihalohydrins, alkyl di- and polyhalides, di- or polycarboxylic acids or their acyl halides and anhydrides, dicyandiamide, urea and formaldehyde, a group derived from low molecular weight reactive resins such as the Bisphenol A type, or a group derived from reaction of a cationic polymeric reactive species such as

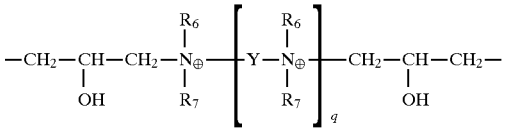

where R and R are selected from $C_1$–$C_5$ alkyl and $C_2$–$C_5$ hydroxyalkyl radicals, Y is selected from $C_2$–$C_6$alkylene radicals, 2-hydroxy-1, 3-propylene radicals, and the radicals:

$—CH_2CH_2NHCONHCH_2CH_2—$ and $—CH_2CH_2CH_2NHCONHCH_2CH_2CH_2—$ and q is an integer of from 0 to 20, provided that when q is greater than 2, each of the symbols Y need not necessarily have the same significance;

D represents a straight or branched chain hydrocarbon, polysiloxane or polyalkylene oxide residue, and which may also either bear functional groups or may contain functional groups, such as amino groups, which may in turn either bear one or more groups $R_1$ or, where B is polyfunctional rather than bifunctional, may represent a further functional reaction point of the group B with the rest of the molecular structure;

E represents a group resulting from the reaction of a bi- or polyfunctional species capable of reacting with amino groups, for example: epihalohydrins, alkyl di- and polyhalides, dicarboxylic acids or their acyl halides and anhydrides, dicyandiamide, urea and formaldehyde;

J represents a residue derived from a polyfunctional polyether;

K represents the monofunctional or polyfunctional residue derived from partial reaction of the basic prepolymers in formulae (I) or (II), i.e. it represents the shaded area in formula (III) as follows:

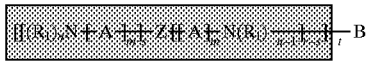

$R_1$ represents a fibre reactive grouping such as the residue derived from monofunctional reaction of an epihalohydrin, an alkyl or alkyl aryl polyhalide or a methylol grouping derived from monofunctional reaction of formaldehyde, or is alkyl, hydroxyalkyl or hydrogen, with the proviso that at least one group $R_1$ per polyoxyalkyleneamine residue, and preferably at least one for each nitrogen, retains residual fibre reactivity;

$R_2$ represents a fibre reactive grouping such as the residue derived from monofunctional reaction of an epihalohydrin, an alkyl or alkyl aryl polyhalide or is a methylol grouping derived from monofunctional reaction of formaldehyde, or alkyl, hydroxyalkyl or hydrogen;

$R_3$ represents hydrogen or $C_1$–$C_4$ alkyl or hydroxyalkyl;

$R_4$ represents halogen or a group $$[[(R_2)_nN]_s J[N(R_2)_{n-1}]_{r-s}]_t \quad (VIII)$$

or one of alkylamino, hydroxyalkylamino, alkoxy, alkylarylamino or a group $—(R_3)_pN—[D]—R_5$ or a functional reaction point of the group B with the rest of the molecular structure, where B is polyfunctional rather than bifunctional;

$R_5$ represents hydrogen or a group $—N(R_2)_n$ or $—N(R_3)_n$;

m is between 4 and 50;

n is 2 or 3, with the proviso that, where n is 3, the nitrogen atom involved also bears a formal positive charge;

p is 1 or 2, with the proviso that, where p is 2, the nitrogen atom involved also bears a formal positive charge;

r equals the functionality of group Z;

t is a number representing the functionality of reaction of the residue B;

s is a number between 1 and r−1;

x is between 2 and 30; and y is from $$\frac{x}{t-1}$$

to x, with the general proviso that, in any given instance, the significance of a particular group Z, A, B, R, J or K in any given structure shall not be dictated by the significance of any other such group in the same formula, and further, wherever a formal positive charge is present in the structure, then an appropriate counter anion is taken to be present, for example chloride ion.

The term "fibre reactive grouping" as used herein is to be understood as meaning a group having residual chemical reactivity such that it will be capable of causing a molecule to be bound to the surface of a fibre in such a way as not to be readily removable therefrom. Examples include the fibre reactive dyes in which a variety of reactive halogen groupings are sited on the molecule and which, during dyeing, react with hydroxy or amino functionalities on the fibre surface to produce a chemical bond. It will be understood that electrical bonding forces, rather than chemical forces, could be involved and that a "reaction" as such need not occur. The terminology further includes species which will be attracted to a fibre surface and bind themselves thereto by means of cross-linking mechanisms.

The term "polyfunctional reactive group" as used herein is to be understood as meaning a group which is capable of reacting with the amino functionality of compounds of formula I or II. The reactivity of group B needs to be complimentary to that of group $R_1$ in those compounds.

It will be understood that the polymers and prepolymers may be derived from mixtures of one or more polyoxyalkyleneamines and that these may be joined by bridging groups. The bridging groups serve to link the polyoxyalkyleneamines and some examples of suitable groups were mentioned above. The bridging groups themselves could, of course, bear reactive species capable of reacting with fibres. It will also be appreciated that the bridging group B could be incorporated into the molecular structure, whilst the prepolymer is being applied to the fibre, as a separate reactive crosslinking agent.

The present invention further provides a method for the treatment of natural or synthetic fibres so as to impart a softer handle and which comprises treating the fibres with a polymer or prepolymer compound of the aforementioned type.

The softening agents and method of this invention may be applied to all types of natural and synthetic fibres, including nylon and acrylic. They are particularly suited to use with wool and cotton, including 100% cotton terry loop towelling, and to cotton or wool blends with synthetic fibres.

The softening agents of the invention may be presented for use in solution in a non aqueous solvent, such as perchloroethylene. More preferably, however, they are in the form of an aqueous solution, optionally with the addition of suitable dispersing agents to reduce the viscosity of the solution. The total amount of polymer solids applied to the fibres is generally from 0.005 to 10.0% by weight, most preferably from 0.05 to 2.0%.

The method of this invention can be performed as either a batch or continuous process using conventional equipment. For example, the softening agent may be applied aqueously by exhaustion on to the goods in a traditional long bath method using suitable machinery, or may be padded onto fabric continuously or applied in foam or by suction-slot techniques. In addition, the agent may be applied to piece goods or fabric from a solvent such as perchloroethylene in suitable machinery.

If desired, the softening agents may be applied in combination with other resins, further softening agents, emulsifiers, pigments, binders fluorescent whitening agents or other materials to confer additional properties or benefits to the material.

It has surprisingly and advantageously been found that the use of polymers and prepolymers of this type as softening agents imparts rather different, and improved, properties to the treated fibres compared with conventional softeners. Not only is a very soft handle achieved, but the finish is also extremely hydrophilic and substantially more durable to subsequent washing or wet processing. The durable softness thus imparted results also in dimensional retention and elasticity in knit cotton structures without recourse to conventional cotton resin finishes. As will be appreciated, this results in considerable benefits for both manufacturers and users of, for example, cotton towelling, bathrobes, underwear and leisurewear.

A further advantage of the softening agents of this invention arises from their extreme water dispersibility. Conventionally employed softening agents are emulsions which create problems of shear instability in such high shear situations as jet dyeing machines, suction slot evacuators, and filtration problems when treating yarn in package dyeing machines, when filtration effects can cause difficulties. These problems are reduced, or totally avoided, with the present softening agents.

A still further surprising aspect of the invention is that these softening agents, when used in combination with one or more conventional softening agents, can result in finishes with considerably superior handle and performance than may be expected. Wash durability, handle and fuming during fabric heat setting, for example, are much improved. In some cases the improvement may be up to or above the levels achieved with either material alone, indicating a synergistic action. Examples of suitable "conventional" fabric softening agents include: oxidised polyethylene wax emulsions; silicone emulsions, especially emulsions of reactive organofunctional silicones, and more especially amonosilicones; fatty amide emulsions; and quaternised fatty amine emulsions.

The present invention will now be illustrated by the following Examples.

EXAMPLE 1

A solution was prepared containing 881 g of a bisaminopropyl polytetrahydrofuran of structure $$H_2N\,CH_2.CH_2.CH_2\!+\!O(CH_2)_4\!\!\!

reflux maintained for approximately 4 hours or until a clear or slightly turbid homogeneous solution is produced when 5 $cm^3$ of the reaction mix is mixed with 30 $cm^3$ water. The reaction mixture was then allowed to cool and used in subsequent experiments.

EXAMPLE 2

Various textile samples were treated with the product of example 1 as follows: scoured goods were placed in a blank bath at a liquor ratio of 30:1 and the bath set to pH 6.5 to 7.0 at 25° C. The required amount of softener was added to the bath in prediluted form 1:10 with water. The bath was raised to 35° C. and then allowed to exhaust, as indicated by the disappearance of the slight turbidity from the bath, which usually took between 15 and 30 minutes. The goods were then removed, hydroextracted and dried in a tumble dryer at between 70° and 100° C.

The results of the tests are presented in Table 1.

TABLE 1

| Article treated | Amount of Product of Example 1 (o.w.f.) | Wetting test* | Handle | Washing test** | Handle after Washing |
|---|---|---|---|---|---|
| 100% cotton terry loop hand towels | 1.73% | instan-taneous | very soft and silky | 7 washes to HLCC5 | very soft |
| 60% cotton 40% nylon intarsia pattern mens socks | 3.46% | 9 seconds | very soft | 10 washes to HLCC5 | very soft |
| | 1.73% | 3 seconds | soft | | soft |
| 60% cotton 40% nylon plain dyed navy mens socks | 3.46% | not deter-mined | very soft | 10 washes to HLCC5 | very soft |
| 100% cotton terry loop bathrobe fabric | 1.73% | 3 seconds | very soft | 10 washes to HLCC5 | very soft |
| | 3.46% | 5 seconds | very soft | | very soft |
| | nil | instant | harsh | | very harsh |

* time taken for a 0.1 $cm^3$ drop of water to sink into the fabric
** in a Wascator FCM 7 according to Home Laundering Consultative Council procedures

EXAMPLE 3

(a) Formulation

A formulation was produced containing 20 parts product from Example 1, 20 parts nonyl phenol 8 mole ethoxylate and 10 parts nonyl phenol 6 mole ethoxylate.

(b) Application 1

A Bowe P421 dry cleaning machine was loaded with 30 kg of 60% mercerised Cotton 40% nylon predyed mens socks. Then 130 liters of perchlorethylene was charged to the machine and the goods tumbled in solvent for 1 minute to wet out. 1.95 kg of the above formulation was then added to the machine via the button trap and the goods tumbled for 5 minutes, then the solvent drained to the still and centrifuged to 100% expression, then tumble dried.

(c) Application 2

The above procedure was repeated, but using 1.43 kg of the above mixture and 1.95 kg water placed in the button trap.

(d) Results

| Example | Wetting time* | Handle | Handle after 7 × HLCC5 |
|---|---|---|---|
| 3b | 8 sec | very soft | soft |
| 3c | 1 sec | very soft | soft |

In addition to the above, the changes in lateral stretching of the sock after washing were measured and compared with an untreated sock.

Percent change in lateral stretch

| | foot | ankle | leg | welt |
|---|---|---|---|---|
| Example 3c | −2.8 | −2.2 | −1.3 | −1.3 |
| Untreated | −8.9 | −8.5 | −7.5 | −2.3 |

This further indicates retention of softness and springness of the knitted structure after washing.

EXAMPLE 4

The product of Example 1 can be prepared as an aqueous solution by distilling out the isopropanol and replacing it with water, thereby minimising fire hazard. 797 parts of the product of Example 1 is distilled at atmospheric pressure until 391 parts of an isopropanol: water distillate is collected. Then, 710 parts of water and 80 parts monoethylene glycol is added to the flask and stirred. The resulting product contains about 20% w/w active solids and only 4–5% isopropanol.

The product was applied to wool and acrylic socks by an exhaustion method as in Example 2. Excellent handle and good durability was achieved.

EXAMPLE 5

The softening agent can be mixed with conventional fatty quaternary ammonium-type softeners to give a product which has excellent handle, good durability and superior hydrophilicity to conventional softeners. Such a product is particularly useful for softening cotton/nylon socks.

a) Formulation the 797 parts of the product of Example 1 were distilled at of a atmospheric pressure until 391 parts of an isopropanol: water distillate were collected. 391 parts of water were added to this, stirred and this product blended with 341 parts of a commercial fatty quaternary ammonium softener (PPT Ltd).

b) Application

The performance of this softener was compared against conventional types on cotton/nylon socks. The softeners were applied as described in Example 2. The results are presented in Table 2.

TABLE 2

Softeners applied to cotton/nylon socks

| Application | Wetting | Handle before wash | Handle 3 × MSB III |
|---|---|---|---|
| 2% Example 5 | 13 sec | 3 | 1 |
| 2% Ceranine PNP[1] | 140 sec | 4 | 4 |
| 1.2% Permavel R[2] | 35 sec | 1 | 3 |
| 1.5% Permavel H[2] | 270 sec | 2 | 2 |
| Scour only | 60 sec | 5 | 5 |

1. Fatty amide softener, Sandoz Products Ltd.
2. Durable silicone softeners, PPT Ltd, prepared as described in European Patent Application No. 89312306.7.

EXAMPLE 6

A stable product can be formulated by taking 100 parts of the product of Example 4 and blending this with 30 parts of a silicone emulsion (eg Finish VP1445E, Wacker Chemicals Ltd). This product was compared for handle on knitted lambswool swatches against a silicone softener (Wacker VP1445E). The softeners were applied by exhaustion, as described in Example 2 using 1–2% product on weight of wool. The new softener gave a super-soft handle, less slippy and more natural than with the silicone. The hydrophilicity was also noticeably superior.

EXAMPLE 7 a) To a solution of 254 g bisaminopropyl polytetrahydrofuran (of the structure in Example 1) in 700 g of a mixture of 70% isopropanol in water was added 39 g DER732 (Dow Chemical Co.) and 7.8 g epichlorohydrin. The mixture was refluxed for 4 hours or until a clear or slightly turbid solution was obtained when 5 $cm^3$ of the product was added to 30 $cm^3$ of water.

b) A solution containing 238 g bisaminopropyl polytetrahydrofuran (of the structure in Example 1) in 712 g isopropanol was prepared. To this was added 27 g DER732 (Dow Chemical Co.), 16.6 g Tego OF3010 (Th. Goldschmidt Ltd) and 7.3 g epichlorohydrin. The mixture was refluxed for 4 hours or until a homogeneous, but turbid, solution was obtained when 5 $cm^3$ of the product was added to 30 $cm^3$ of water.

EXAMPLE 8

The products of Example 4 and Examples 7a and 7b were applied to a variety of knitted cotton fabrics (double jersey, single jersey, loopback interlock and pique). The softeners were applied by a) padding: the softeners were applied wet-on-wet to the fabrics from a solution containing 25 g/l product, pH7, 25° C. at 100% pick-up and b) exhaustion: as given in Example 2 using 2.5% o.w.g. product. The fabrics were stenter dried and commercially finished then compared for handle and durability to washing against a standard fatty amide softener. A co-applied mixture of the product of Example 4 and a polyethylene wax emulsion (Bradsyn G, Hickson & Welch Ltd) was also evaluated. The relative handle and durability assessments were as follows.

In general, the handle before and after wash was superior when softeners were applied by a padding technique compared with exhaustion. Before washing the softeners were comparable in softness to the standard silicone softener (Edunine SE, ICI Colours & Fine Chemicals); after wash, (3×HLCC4), the standard softener could be readily distinguished by its harsher handle. The Example 4/polyethylene wax mixture performed particularly well on all fabric types, giving a cool, soft handle and excellent drape.

EXAMPLE 9

The softening agents of the invention are particularly suited to use on towels and towelling fabric as a consequence of their superior hydrophilicity. The products were applied by a wet-on-wet continuous pad treatment at 80% pick-up, from solutions containing 20–40 g/l softener to Egyptian combed cotton towelling. The fabrics were tumble tried and finished as towels. A warm, soft handle is achieved with excellent rewettability, as compared with silicone- and fatty amide-type softeners. The new softeners impart a fuller, more luxurious feel to towelling and a silkier handle. The durability of the softeners was assessed by subjecting the towels to seven domestic washes, without additional fabric conditioner and line dried. The towels treated with the new softeners retain their original appearance, with a full, soft handle.

EXAMPLE 10

The product of Example 4 was compared for yellowing at high temperatures against standard silicone- and fatty amide-type softeners. The products were applied to 50/50 polyester/cotton by padding from solutions containing 1 g/l wetting agent (Fullwet PPT Ltd) and 10–40 g/l softener. The fabrics were padded to 100% pick-up then dried. Yellowing of the fabrics was assessed by heating the fabrics on an electrically-heated press for up to 3 minutes.

| Temperature | Comments |
|---|---|
| 180° C. | Little difference between products |
| 200° C. | Example 4 showed no yellowing at 1,2,3 mins at all levels. Other products yellowed slightly. |
| 220° C. | Slight yellowing of Example 4. Other products were markedly yellowed. |

We claim:

1. A method for the treatment of cotton fibers, blends of wool with synthetic fibers, or synthetic fibers, so as to impart a softer handle, which comprises contacting the fibers with a polymer or prepolymer having the following structural formulae:

i)

$$J(N(R_1)_n)_r$$

or ii)

$$(((R_1)_nN)_s\ J(N(R_1)_{n-1})_{r-s})_tB$$

where N is nitrogen;

J represents a residue derived from a polyfunctional polyether and represented by the grouping:

$$—(A)_m—Z—(A)_m— \text{ or } ((A_m))_3Z^1$$

where Z is a $C_2$–$C_4$ alkylene group; and $Z^1$ represents:

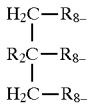

where each $R_2$ is the same or different and is selected from
hydrogen,
or an ethyl group,
and each $R_8$ is the same or different and is selected from:
a direct bond,
or a methylene group;
where A represents:

$$—O—R_9—$$

and is always linked to Z or $Z^1$ by the oxygen atom (O);
where $R_9$ represents a $C_2$–$C_4$ alkylene group, with the proviso that each individual group $R_9$ in any structure is the same or different from any other group $R_9$ in that structure;
B is a bi- or polyfunctional bridging or connecting group;
$R_1$ represents a residue derived from monofunctional reaction of an epihalohydrin, an alkyl or alkyl aryl polyhalide, or a methylol grouping derived from monofunctional reaction of formaldehyde, or is alkyl, hydroxyalkyl or hydrogen, with the proviso that each individual group $R_1$ in any structure is the same or different from any other group $R_1$ in that structure;
m is between 4 and 50;
n is 2 or 3, with the proviso that, where n is 3, the nitrogen atom involved also bears a formal positive charge;
r is either 2 or 3;
t is a number representing the functionality of the residue B;
s=1 when r=2, and s=2 when r=3;
with the proviso that wherever a formal positive charge is present in the structure, then a counteranion is present.

2. The method as claimed in claim 1, wherein the total amount of polymer solids applied to the fibres is from 0.005% to 10.0% by weight.

3. The method as claimed in claim 1, wherein the total amount of polymer solids applied to the fibres is from 0.05% to 2.0% by weight.

4. The method as claimed in claim 1, wherein the polymer or prepolymer is presented for use in the form of an aqueous solution.

5. The method as claimed in claim 1, wherein the polymer or prepolymer is presented for use as a solution in a non-aqueous solvent or is applied from a non-aqueous solvent in an aqueous solution.

6. The method as claimed in claim 1, wherein the fibres being treated comprise cotton.

7. The method as claimed in claim 1, wherein the fibres being treated comprise nylon or acrylic.

8. The method as claimed in claim 1, wherein the fibers being treated comprise a cotton or wool blend with synthetic fibres.

9. The method as claimed in claim 1, wherein the polymer or prepolymer is applied in conjunction with one or more other softening agents.

10. The method as claimed in claim 1, and which is performed as a continuous process.

11. The method as claimed in claim 1, and which is performed as a batch process.

12. A method for treatment of cotton fibers, blends of wool with synthetic fibers or synthetic fibers, so as to impart a softer handle, which comprises contacting the fibers with a polymer or prepolymer as defined in claim 1 and which is manufactured from:

$$H_2NCH_2.CH_2.CH_2\text{-}(O(CH_2)_4)_a\text{-}OCH_2.CH_2.CH_2NH_2,$$

wherein a has an average value of about 28.

* * * * *